US007946675B2

(12) United States Patent
Izuo et al.

(10) Patent No.: US 7,946,675 B2
(45) Date of Patent: May 24, 2011

(54) LIQUID EJECTING APPARATUS AND EJECTION INSPECTING METHOD

(75) Inventors: Seiji Izuo, Shiojiri (JP); Kazutoshi Fujishima, Chino (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

(21) Appl. No.: 12/553,039

(22) Filed: Sep. 2, 2009

(65) Prior Publication Data

US 2010/0053244 A1 Mar. 4, 2010

(30) Foreign Application Priority Data

Sep. 3, 2008 (JP) ..... 2008-225462

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 2007/0052745 | A1 * | 3/2007 | Izuo | 347/14 |
| 2009/0073208 | A1 * | 3/2009 | Komatsu et al. | 347/19 |

FOREIGN PATENT DOCUMENTS

| | | | |
|---|---|---|---|
| JP | 2005-262867 | A | 9/2005 |
| JP | 2006-088475 | A | 4/2006 |
| JP | 2008-168526 | A | 7/2008 |
| JP | 2009-066806 | A | 4/2009 |
| JP | 2009-072973 | A | 4/2009 |

* cited by examiner

*Primary Examiner* — Julian D Huffman
(74) *Attorney, Agent, or Firm* — Kilpatrick Townsend & Stockton LLP

(57) ABSTRACT

Provided is a liquid ejecting apparatus including: a liquid ejecting head that ejects liquid from nozzle openings by driving of an ejection driving portion; a driving signal generation portion that generates a driving pulse for driving the ejection driving portion; a liquid receiving portion that is disposed so as to oppose a nozzle forming face of the liquid ejecting head and receive ink ejected from the nozzle openings; and an ejection inspecting portion that detects an electrical variation occurring between a conductive portion of the liquid ejecting head and the liquid receiving portion when liquid is ejected toward the liquid receiving portion from the nozzle openings in a state where an electric voltage is applied between the conductive portion and the liquid receiving portion, thereby inspecting whether or not liquid has been ejected from the nozzle openings. The driving signal generation portion generates a normal driving pulse which is used for processes other than an ejection inspection process by the ejection inspecting portion and an ejection inspection driving pulse which is different from the normal driving pulse and is used for the ejection inspection process by the ejection inspecting portion.

4 Claims, 7 Drawing Sheets

LIQUID EJECTING APPARATUS AND EJECTION INSPECTING METHOD

This application claims priority to Japanese Patent Application No. 2008-225462, filed Sep. 3, 2008, the entirety of which is incorporated by reference herein

BACKGROUND

1. Technical Field

The present invention relates to a liquid ejecting apparatus such as an ink jet printer and an ejection inspecting method. More particularly, the invention relates to a liquid ejecting apparatus having a liquid ejecting head supplying a driving signal to operate an ejection driving portion, thereby causing liquid drops to be ejected from nozzle openings, and an ejection inspecting method thereof.

2. Related Art

For example, a liquid ejecting apparatus is an apparatus, that has a liquid ejecting head capable of ejecting liquid, for ejecting various types of liquid from the liquid ejecting head. A typical example of the liquid ejecting apparatus is an image recording apparatus such as an ink jet printer (hereinafter, simply referred to as a printer) that includes an ink jet recording head (hereinafter, simply referred to as a recording head) as the liquid ejecting head and ejects liquid ink from the nozzle openings of the recording head so as to land on a recording medium (ejection target material) such as a recording sheet, thereby performing the recording of an image and the like. In recent years, the liquid ejecting apparatus is also used for various manufacturing apparatuses such as an apparatus for manufacturing color filters of a liquid crystal display and the like, without being limited to the image recording apparatus.

For example, in the above-described printer, when ink is not ejected from any of the plurality of nozzle openings, namely, a so-called missing dot phenomenon occurs, images cannot be printed properly on the recording medium. A technique has already been proposed for inspecting whether or not ink was correctly ejected from all the nozzle openings. For example, JP-A-2008-168526 discloses a technique that causes ink to be electrically charged, allows the charged ink to fly between electrodes, and detects a change in voltage between the electrodes, thereby inspecting whether or not the ink was ejected.

However, it is difficult with the above-described technique to have one shot of ink charged with a sufficient amount of electricity, and hence, there are concerns with the low detection signal level. For this reason, it is difficult to inspect missing dots with a sufficiently high degree of accuracy.

A high detection level can be obtained by having ejecting ink several times from one nozzle opening. However, in doing so, the amount of the ink consumed for the ejection inspection process will increase.

SUMMARY

An advantage of some aspects of the invention is that it provides a liquid ejecting apparatus capable of achieving an improvement in the inspection accuracy of the inspecting of whether or not liquid has been ejected from nozzle openings and an ejection inspecting method thereof.

According to an aspect of the invention, there is provided a liquid ejecting apparatus including: a liquid ejecting head that ejects liquid from nozzle openings by the driving of an ejection driving portion; a driving signal generation portion that generates a driving pulse for the driving of the ejection driving portion; a liquid receiving portion that is disposed so as to oppose a nozzle forming face of the liquid ejecting head and receive ink ejected from the nozzle openings; and an ejection inspecting portion that detects an electrical variation occurring between a conductive portion of the liquid ejecting head and the liquid receiving portion when liquid is ejected toward the liquid receiving portion from the nozzle openings in a state where an electric voltage is applied between the conductive portion and the liquid receiving portion of the liquid ejecting head, thereby inspecting whether or not liquid has been ejected from the nozzle openings, wherein the driving signal generation portion generates a normal driving pulse which is used for processes other than the ejection inspection process by the ejection inspecting portion and an ejection inspection driving pulse which is different from the normal driving pulse and is used for the ejection inspection process by the ejection inspecting portion.

Here, the "conductive portion" refers to a member which has conductive properties and has a portion making contact with the liquid in the liquid ejecting head.

Here, the "processes other than the ejection inspection process" refer to processes which are mainly performed by the liquid ejecting apparatus.

In the above configuration, the ejection inspection driving pulse is configured such that the flying speed of the liquid ejected during the ejection inspection process is higher than the flying speed of the liquid ejected in response to the normal driving pulse.

According to such a configuration, the ejection inspection is performed using the inspection driving pulse where the flying speed thereof is higher than the flying speed of the liquid ejected in response to the normal driving pulse. Therefore, compared to a configuration where the ejection inspection is performed using the normal driving pulse, it is possible to further increase the amplitude (detection voltage) of the detection signal. Owing to such a configuration, it is possible to improve detection sensitivity and improve determination accuracy in the determination of whether or not liquid has been ejected. Moreover, since the amplitude of the detection signal can be increased, it is possible to decrease the number of ejections of liquid per one nozzle opening during the inspection. As a result, it is possible to decrease the amount of the liquid consumed for the ejection inspection.

In the described configuration, the processes other than the ejection inspection process may be a printing process for ejecting ink as the liquid to perform printing on a recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings. In the embodiments shown below, although various limitations are given as a preferred specific embodiment of the invention, the scope of the invention is not limited to these embodiments unless otherwise specified. In the description shown below, an ink jet printer (hereinafter, referred to as a printer) illustrated in FIG. 1 is exemplified as the liquid ejecting apparatus according to the invention.

Figure 1:
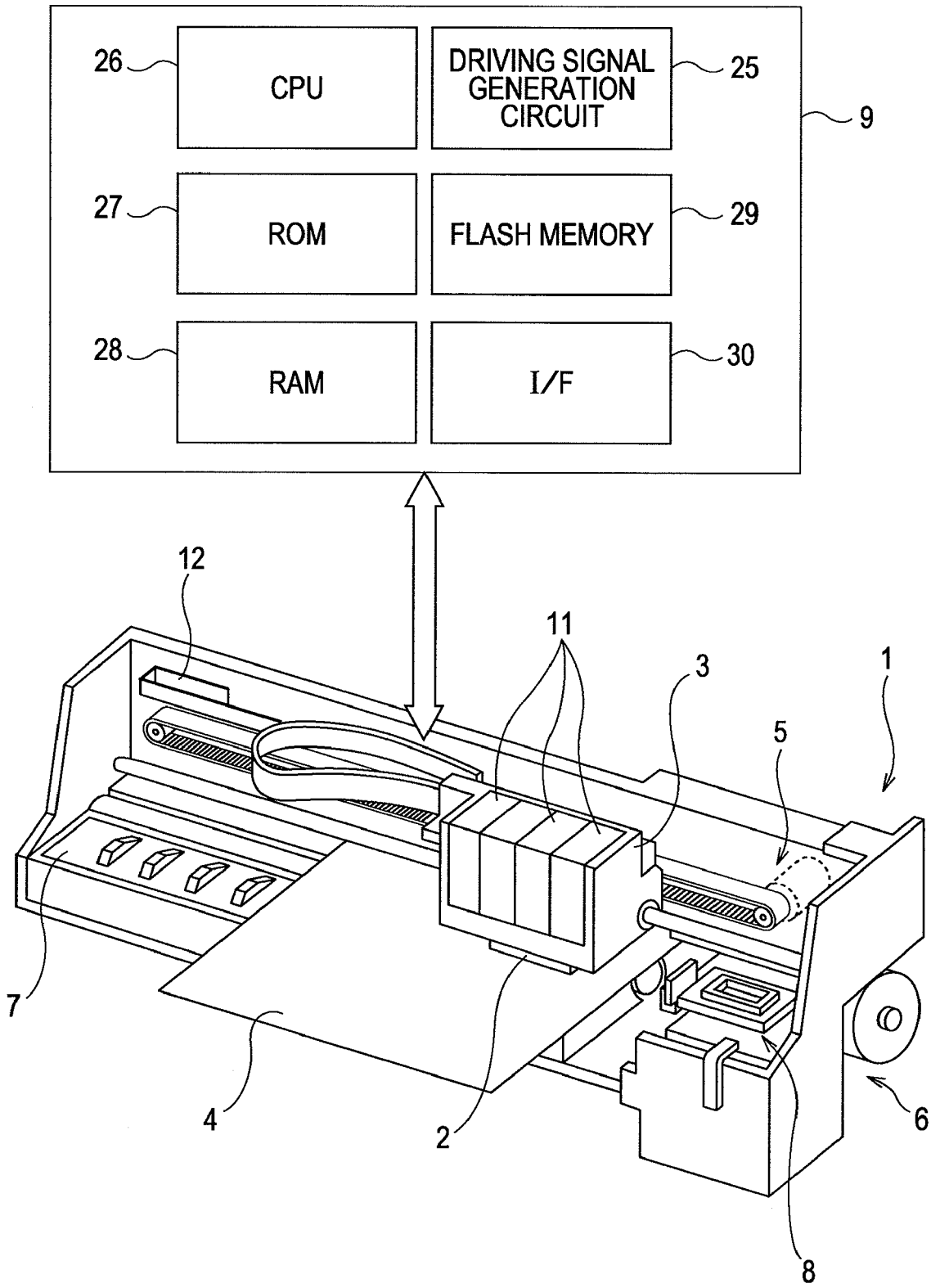
FIG. 1 is a block diagram and a perspective view for describing a simplified configuration of a printer.

As illustrated in FIG. 1, a printer 1 according to the present embodiment includes an ink jet recording head (hereinafter, referred to as a recording head) 2, as a liquid ejecting head, which is mounted on a carriage 3. The printer 1 further includes a carriage moving mechanism 5 that reciprocates the carriage 3 in the main scanning direction which is the width direction of a recording sheet 4 (a recording medium or an example of an ejection target material), a sheet transporting mechanism 6 that transports the recording sheet 4 in the sub scanning direction perpendicular to the main scanning direction, a platen 7 that mounts the recording sheet 4 thereon, a capping mechanism 8 that is disposed at a position (home position) located outside one end in the main scanning direction of the platen 7, and a controller 9 that controls the overall operation of the printer 1.

The carriage 3 has ink cartridges 11 which are removably mounted thereon and are configured to store ink of the respective colors of yellow (Y), magenta (M), cyan (C), and black (K), and the respective inks of the ink cartridges 11 are supplied to the recording head 2. In the printer body, a linear encoder 12 is disposed for detecting the position of the carriage 3, so that the position of the carriage 3 can be controlled based on a detection signal from the linear encoder 12.

Figure 2:
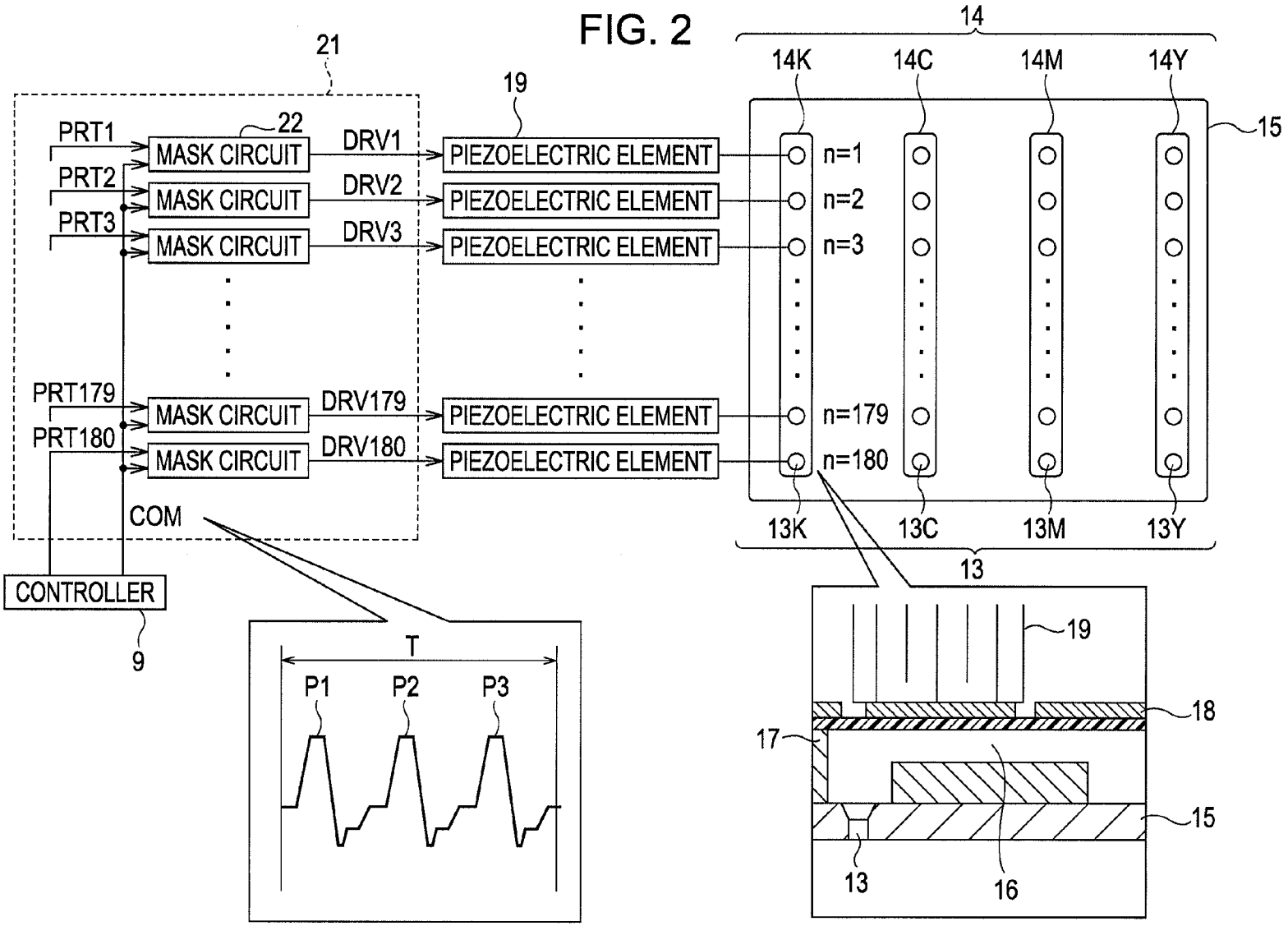
FIG. 2 is a schematic view illustrating the configuration of a recording head.

As illustrated in FIG. 2, the recording head 2 includes a nozzle plate 15 that has nozzle openings 13 formed therein, a channel forming plate 17 that forms ink channels, each ink channel including a pressure generating chamber 16 which is linked with each of the nozzle openings 13, a flexible vibration plate 18 that seals the openings of the pressure generating chambers 16, and piezoelectric elements 19 that are bonded to the upper surface of the vibration plate 18. On the nozzle plate 15, a plurality (180 in the present embodiment) of nozzle openings 13 ejecting ink of the respective colors of cyan (C), magenta (M), yellow (Y), and black (K) is arranged along the sub scanning direction, whereby nozzle arrays 14 are formed. The nozzle arrays 14 are provided in four columns (14C, 14M, 14Y, and 14K) in total so as to correspond to the respective colors.

The recording head 2 also includes a plurality of mask circuits 22 which are provided on a head driving substrate 21 so as to each correspond to a plurality of piezoelectric elements 19 driving the respective nozzle openings 13. An electric voltage (driving signal) is applied from the mask circuits 22 to the piezoelectric elements 19 so as to expand or contract the piezoelectric elements 19, thus expanding or contracting the volume of the pressure generating chambers 16 and causing a pressure variation to occur to the ink in the pressure generating chambers 16. By controlling the pressure variation, ink is ejected from the nozzle openings 13. The mask circuits 22 are supplied with a print signal PRTn or a driving signal COM which is generated by a driving signal generation circuit 25 (see FIG. 1 for an example of a driving signal generation portion of the invention) of the controller 9. Here, the letter n at the end of the print signal PRTn is a number for specifying the nozzle contained in the nozzle array. In the present embodiment, since one nozzle array consists of 180 nozzles, n is any integer from 1 to 180.

As illustrated in FIG. 1, the controller 9 is configured as a microprocessor composed mainly of a CPU 26 (which functions as an ejection inspecting portion of the invention in collaboration with a later-described ejection inspecting unit 32). The controller 9 includes a ROM 27 for storing various processing programs, a RAM 28 for temporarily storing data or preserving data, a flash memory 29 which is capable of writing and erasing data therein and therefrom, and an interface (I/F) 30 for performing the exchange of information with external apparatuses. The respective processing programs of a main routine, a later-described ejection inspection routine, and a print processing routine are stored in the ROM 27. In addition, a print buffer area is provided in the RAM 28, and print data sent from an external apparatus through the I/F 30 are stored in the print buffer. To the controller 9, not only is a position signal or the like from the linear encoder 12 input through a non-illustrated input port, but also print jobs output from an external apparatus is input through the I/F 30. From the controller 9, not only are a control signal to the recording head 2 (including the mask circuits 22 or the piezoelectric elements 19), a control signal to the carriage moving mechanism 5, a driving signal to the sheet transporting mechanism 6, a motion control signal to the capping mechanism 8 output through a non-illustrated output port, but also print status information intended for an external apparatus is output through the I/F 30.

As illustrated in FIG. 2, the driving signal generation circuit 25 is configured to output a driving signal COM to the mask circuits 22 during one pixel period (one ejection cycle or one recording cycle), the driving signal mainly composed of three driving pulses, a first ejection pulse PI, a second ejection pulse P2, and a third ejection pulse P3, which are repeated in this order. These ejection pulses P1 to P3 will be collectively referred to as a normal driving pulse P. The normal driving pulse P is a driving pulse which is used in a normal recording mode (print mode) where ink is ejected from the nozzle openings 13 to print images, text, or the like on the recording sheet 4. The driving signal generation circuit 25 also generates an inspection driving signal COM' which is used in a later-described ejection inspection routine. The inspection driving signal COM' is a driving signal which contains an inspection driving pulse Pt in which the flying speed of the ink thereof is higher than that of the normal driving pulse P. Upon receiving the driving signal COM (COM') or the print signal PRTn, the mask circuits 22 selectively output a necessary pulse selected from the pulses of the driving signal COM (COM') based on these signals to the piezoelectric elements 19 to be used as a driving pulse DRVn.

Figure 3A:
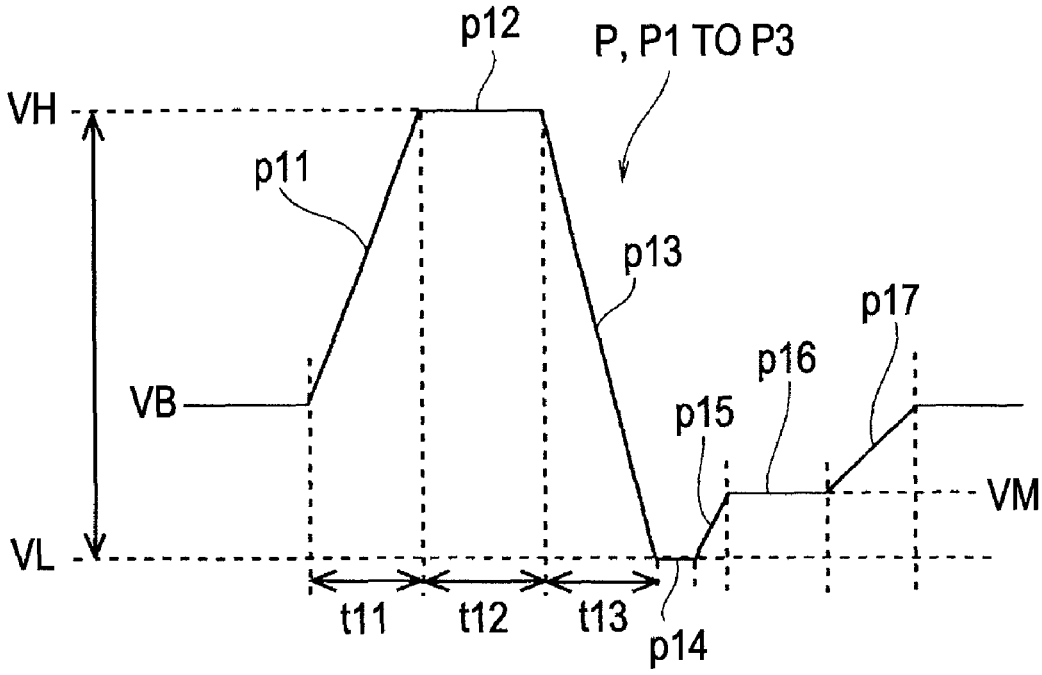
FIG. 3A is a waveform diagram of a normal driving pulse.
Figure 3B:
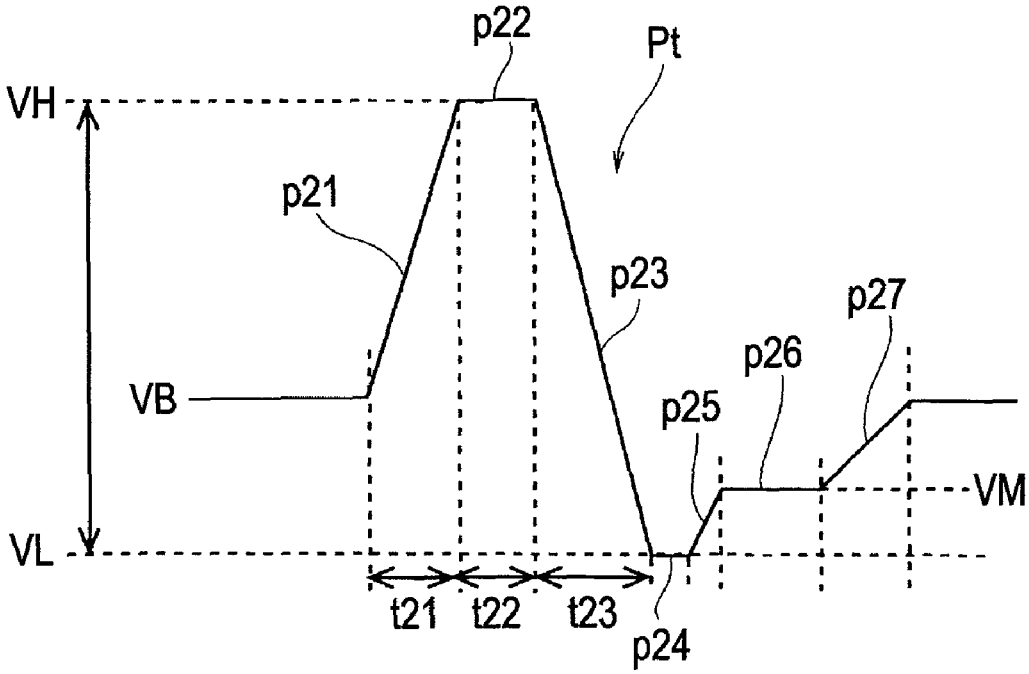
FIG. 3B is a waveform diagram of an inspection driving pulse.

FIGS. 3A and 3B are waveform diagrams for respectively describing the configuration of the normal driving pulse P of the driving signal COM generated by the driving signal generation circuit 25 and the configuration of the inspection driving pulse Pt of the inspection driving signal COM'.

As illustrated in FIG. 3A, the normal driving pulse P is configured to include a first preliminary expansion zone p11 where the potential is increased with a constant gradient from a reference potential VB to the highest potential VH, a first expansion hold zone p12 where the highest potential VH which is the rear-end potential of the first preliminary expansion zone p11 is maintained for a predetermined period of time, a first ejection zone p13 where the potential is decreased with a relatively steep gradient from the highest potential VH to the lowest potential VL, a first contraction hold zone p14 where the lowest potential VL is maintained for a predetermined period of time, a first intermediate expansion zone p15 where the potential is increased with a constant gradient from the lowest potential VL to an intermediate potential VM between the lowest potential VL and the reference potential VB, a first intermediate hold zone p16 where the intermediate potential VM is maintained for a predetermined period of time, and a first restoring expansion zone p17 where the potential is restored with a constant gradient from the intermediate potential VM to the reference potential VB.

As illustrated in FIG. 3B, the inspection driving pulse Pt of the inspection driving signal COM' has the same waveform factors as the normal driving pulse P and is configured to include a second preliminary expansion zone p21 where the potential is increased with a constant gradient from a reference potential VB to the highest potential VH, a second expansion hold zone p22 where the highest potential VH, which is the rear-end potential of the second preliminary expansion zone p21, is maintained for a predetermined period of time, a second ejection zone p23 where the potential is decreased with a relatively steep gradient from the highest potential VH to the lowest potential VL, a second contraction hold zone p24 where the lowest potential VL is maintained for a predetermined period of time, a second intermediate expansion zone p25 where the potential is increased with a constant gradient from the lowest potential VL to the intermediate potential VM, a second intermediate hold zone p26 where the intermediate potential VM is maintained for a predetermined period of time, and a second restoring expansion zone p27 where the potential is restored with a constant gradient from the intermediate potential VM to the reference potential VB.

The described driving pulses P and Pt have the following effects when supplied to the piezoelectric elements 19. First, when the pulses of the preliminary expansion zones p11 and p21 are supplied to the piezoelectric elements 19, the corresponding piezoelectric elements 19 are contracted, and accordingly, the volume of the corresponding pressure generating chambers 16 is expanded from a reference volume corresponding to the reference potential VB to the maximum volume corresponding to the highest potential VH. As a result, the meniscus exposed to the nozzle openings 13 is absorbed towards the pressure generating chambers. The expansion state of the pressure generating chambers 16 is maintained at a constant level during the entire supply periods of the pulses of the expansion hold zones p12 and p22.

When the pulses of the ejection zones p13 and p23 are supplied to the piezoelectric elements 19 subsequently to the expansion hold zones p12 and p22, the corresponding piezoelectric elements 19 are expanded, and accordingly, the volume of the corresponding pressure generating chambers 16 is abruptly contracted from the maximum volume to the minimum volume corresponding to the lowest potential VL. The ink in the pressure generating chambers 16 is pressurized by the abrupt contraction of the pressure generating chambers 16, whereby several picoliters to several tens of picoliters of ink is ejected from the nozzle openings 13. The contraction state of the pressure generating chambers 16 is maintained for a short period of time during the supply periods of the pulses of the contraction hold zones p14 and p24. Thereafter, the pulses of the intermediate expansion zones p15 and p25, the intermediate hold zones p16 and p26, and the restoring expansion zones p17 and p27 are sequentially supplied to the piezoelectric elements 19, whereby the volume of the pressure generating chambers 16 are restored from the volume corresponding to the lowest potential VL to a reference volume corresponding to the reference potential VB.

As described above, the normal driving pulse P and the inspection driving pulse Pt have the same basic functions for ejecting ink. However, the two pulses are configured differently so that the flying speeds of the ink ejected from the nozzle openings 13 when the respective pulses are applied to the piezoelectric elements 19 are different. Specifically, the flying speed Vmt of the ink ejected using the inspection driving pulse Pt in the ejection inspection routine is set so as to be higher than the flying speed Vm of the ink ejected using the normal driving pulse P in the normal recording mode. More specifically, at least one waveform factor from the time interval t21 of the second preliminary expansion zone p21, the time interval t22 of the second expansion hold zone p22, and the time interval t23 of the second ejection zone p23 is made shorter or longer than that of the corresponding waveform factor of the normal driving pulse P so that the flying speed of the ink ejected using the inspection driving pulse Pt is increased. In the present embodiment, the time interval t23 of the second ejection zone p23 is made slightly longer than the time interval t13 of the first ejection zone p13, whereas the time interval t21 of the second preliminary expansion zone p21 is made shorter than the time interval t11 of the first preliminary expansion zone p11, and the time interval t22 of the second expansion hold zone p22 is made shorter than the time interval t12 of the first expansion hold zone p12.

Figure 4:
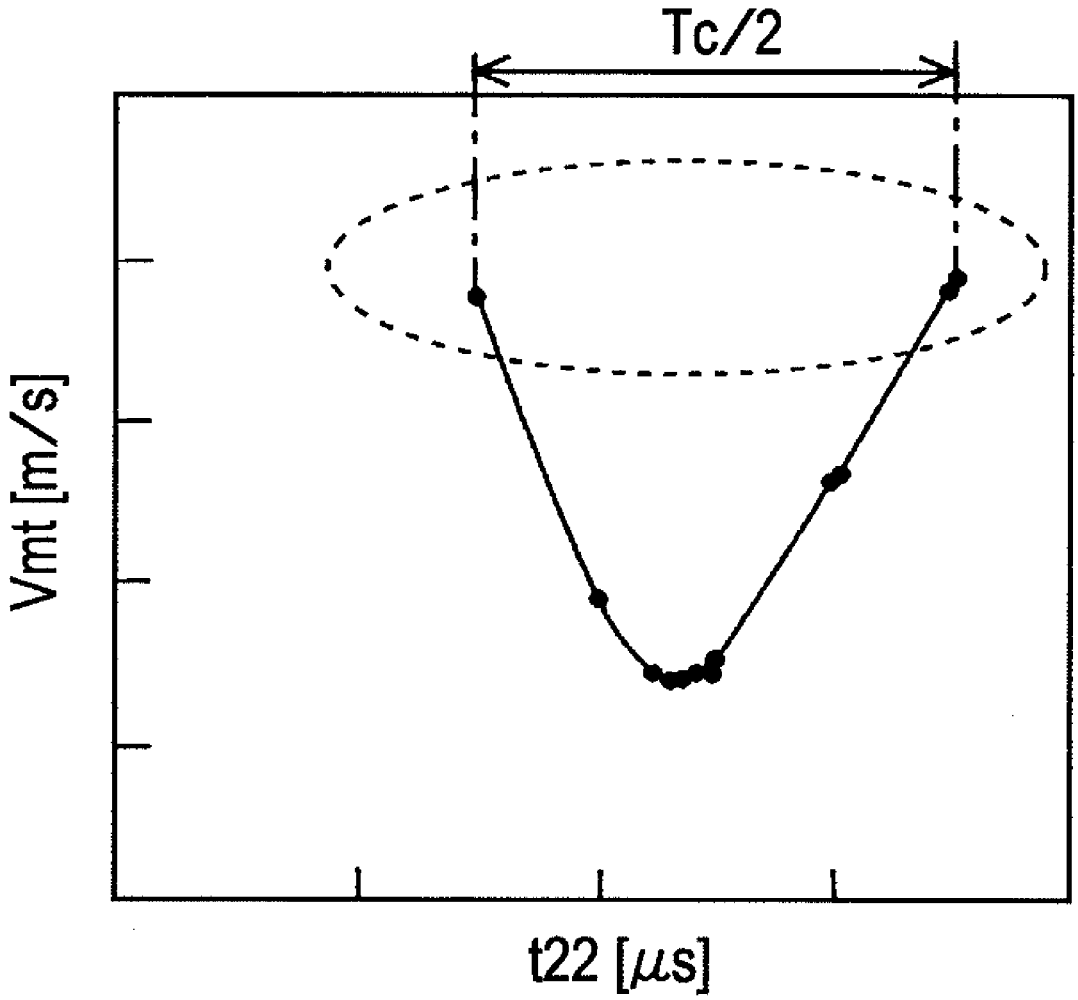
FIG. 4 is a graph illustrating a change in the flying speed of the ink when the time interval of an expansion hold zone of the driving pulse is changed.

FIG. 4 is a graph illustrating the change in the flying speed Vmt of the ink when the time interval t22 of the second expansion hold zone p22 is changed. As is understood from the graph, the flying speed Vmt of the ink increases or decreases when the time interval t22 is changed. Here, the flying speed of the ejected ink varies depending on the state of the meniscus at the ejection timings, specifically the vibration of the meniscus. The vibration of the meniscus is greatly influenced by the natural vibration frequency Tc induced on the ink in the pressure generating chamber 16. Therefore, the frequency of the change in the flying speed of the ink corresponds to the natural vibration frequency Tc. Therefore, by setting the time intervals of the respective waveform factors in consideration of the natural vibration frequency Tc, the flying speed Vmt of the ink can be increased.

With the use of the inspection driving pulse Pt configured in this way, it was confirmed that the flying speed Vmt of the ink can be increased by about several ten of percent compared to the flying speed Vm of ink obtained with the normal driving pulse P. Moreover, the amount of ejected ink did not change much. In other words, it is possible to have only the flying speed increased while suppressing a change in the amount of ejected ink. The inspection driving pulse Pt, which is capable of increasing the flying speed of the ink compared to the case of using the normal driving pulse P, is not suitable to be used for printing images or the like during the normal recording mode. This is because the flying direction of ejected ink may bend considerably compared to the flying direction of the ink during a normal printing, or the scattering of ink droplets (satellite ink droplets) may occur which accompany the main ink droplets. However, the bending of the flying direction of the ink or the occurrence of the satellite ink droplets does not significantly influence the inspection accuracy in a later-described ejection inspection routine.

The configuration used for increasing the flying speed of the ink ejected using the inspection driving pulse Pt is not limited to the configuration illustrated in the present embodiment. For example, the entire waveform factors of the time interval t21 of the second preliminary expansion zone p21, the time interval t22 of the second expansion hold zone p22, and the time interval t23 of the second ejection zone p23 may be changed from those of the corresponding waveform factors of the normal driving pulse P, and the time interval of any one waveform factor may be changed. Moreover, for example, the flying speed may be adjusted by changing the reference potential VB without changing the time intervals of the respective zones. Specifically, by setting the reference potential VB' of the inspection driving pulse Pt so as to be higher than the reference potential VB of the normal driving pulse P, it is possible to increase the flying speed Vmt of the ink ejected using the inspection driving pulse Pt so as to be higher than the flying speed Vm of the ink ejected using the normal driving pulse P. Any other method may be used as long as it is possible to increase the flying speed Vmt so that it is higher than the flying speed Vm.

In the above-described embodiment, although the driving pulses P and Pt illustrated in FIG. 3 are described as examples of the driving pulse of the invention, the form of the pulse is not limited to the described form. A driving pulse with any form may be used as long as the driving pulse is configured to have at least an expansion zone where the pressure generating chambers 16 are preliminarily expanded, a expansion hold zone where the expansion state of the pressure generating chambers 16 is maintained for a predetermined period of time, and an ejection zone where the pressure generating chambers 16 are contracted to eject ink from the nozzle openings 13.

Next, the description of an ejection inspection routine (ejection inspection process) in the thus-configured printer 1 will be provided, which is an inspection as to whether or not ink is properly ejected from the respective nozzle openings 13.

Figure 5:
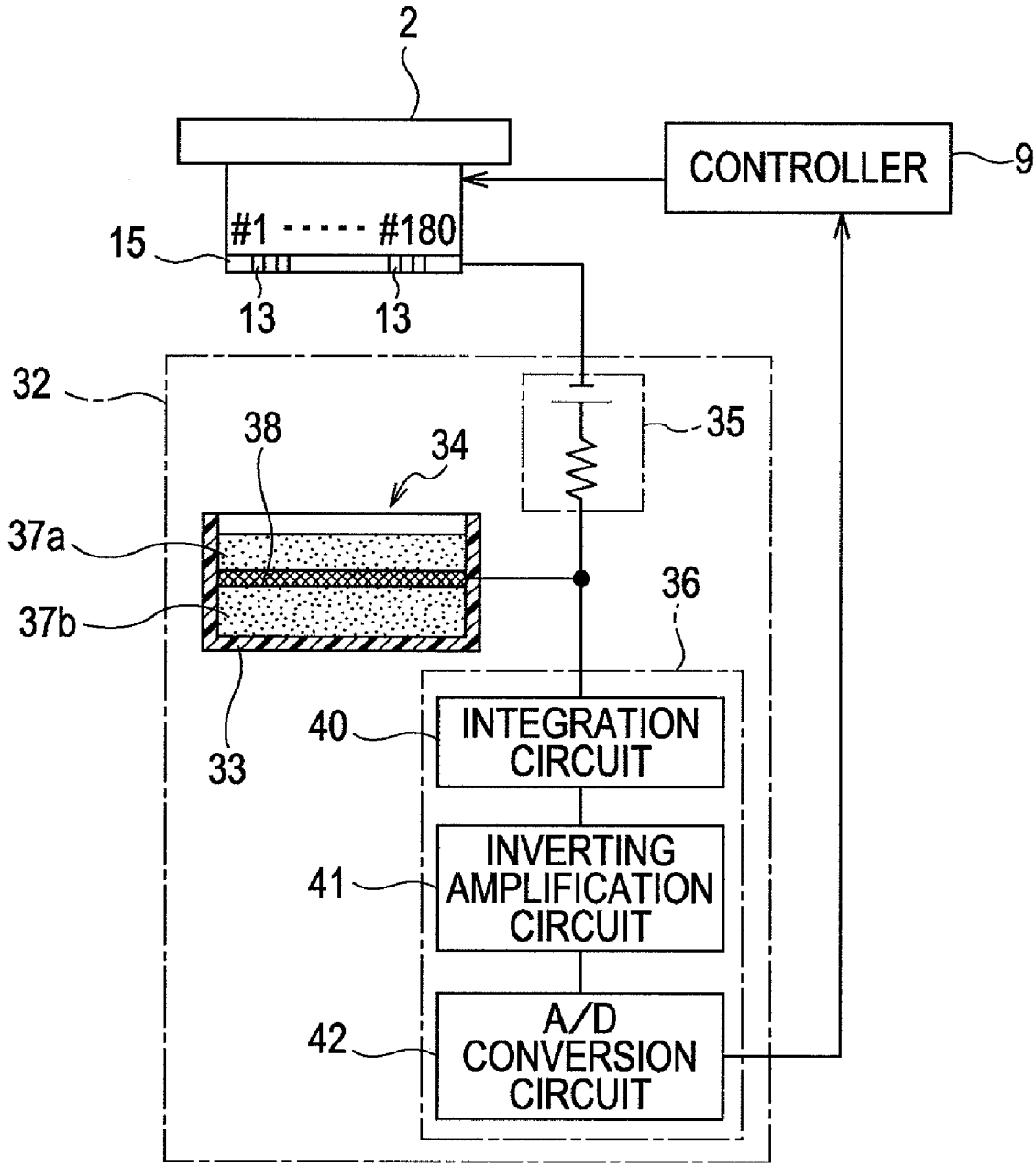
FIG. 5 is a schematic view illustrating the configuration of an ejection inspecting unit.

FIG. 5 is a schematic view illustrating the configuration of an ejection inspecting unit 32 (which functions as the ejection inspecting portion of the invention in collaboration with the CPU 26) that performs the ejection inspection routine.

As illustrated in FIG. 5, the ejection inspecting unit 32 is configured to include a cap member 33 as a liquid receiving portion that is provided to the capping mechanism 8 disposed at the home position, an inspection area 34 that is provided inside the cap member 33, a voltage application circuit 35 that applies an electric voltage between the inspection area 34 and the nozzle plate 15 of the recording head 2 (an example of a conductive portion of the invention), and a voltage detection circuit 36 that detects the voltage of the inspection area 34. The cap member 33 is a tray-like member having an open top and is formed of an elastic member such as an elastomer. An ink absorber 37 is arranged inside the cap member 33. The ink absorber 37 is composed of an upper absorber 37*a* and a lower absorber 37*b*, and a mesh-like electrode member 38 is arranged between the absorbers 37*a* and 37*b*. The upper absorber 37*a* is made from a sponge with conductive properties so as to be at the same potential as the electrode member 38. This sponge has a high permeability such that the landing ink droplets can quickly move to the lower side. In the present embodiment, an ester-based urethane sponge is used as the sponge. The top surface of the upper absorber 37*a* corresponds to the inspection area 34. The lower absorber 37*b* retains the ink longer than the upper absorber 37*a* and is made from a nonwoven fabric such as felt. The electrode member 38 is formed as a grid mesh made of metal such as stainless steel. Accordingly, the ink once absorbed by the upper absorber 37*a* passes through clearances of the grid-like electrode member 38 and is then absorbed and held by the lower absorber 37*b*.

It should be noted that either or both of the upper absorber 37*a* and the lower absorber 37*b* may be omitted.

The voltage application circuit 35 electrically connects the electrode member 38 and the nozzle plate 15 of the recording head 2 via a DC source (for example, several hundreds of volts [V]) of the printer body and a resistor element (for example, several mega-ohms [MΩ]) so that the electrode member 38 becomes the positive electrode and the nozzle plate 15 becomes the negative electrode. Here, since the electrode member 38 is in contact with the upper absorber 37*a* having conductive properties, the top surface of the upper absorber 37*a*, namely the inspection area 34, is also at the same potential as the electrode member 38. The voltage detection circuit 36 includes an integration circuit 40 that integrates and outputs a voltage signal of the electrode member 38, an inverting amplification circuit 41 that inverts, amplifies, and outputs the signal output from the integration circuit 40, and an A/D conversion circuit 42 that A/D-converts the signal output from the inverting amplification circuit 41 and outputs the converted signal to the controller 9. The integration circuit 40 integrates the change in voltage (an example of an electrical variation) resulting from the flight and landing of a plurality of ink droplets so as to output the voltage change as a significant voltage change. The inverting amplification circuit 41 not only inverts the sign of the voltage change but also amplifies and outputs the signal output from the integration circuit 40 by a predetermined amplification rate. The A/D conversion circuit 42 converts the analog signal output from the inverting amplification circuit 41 to a digital signal and outputs the digital signal to the controller 9 as a detection signal.

Figure 6A:
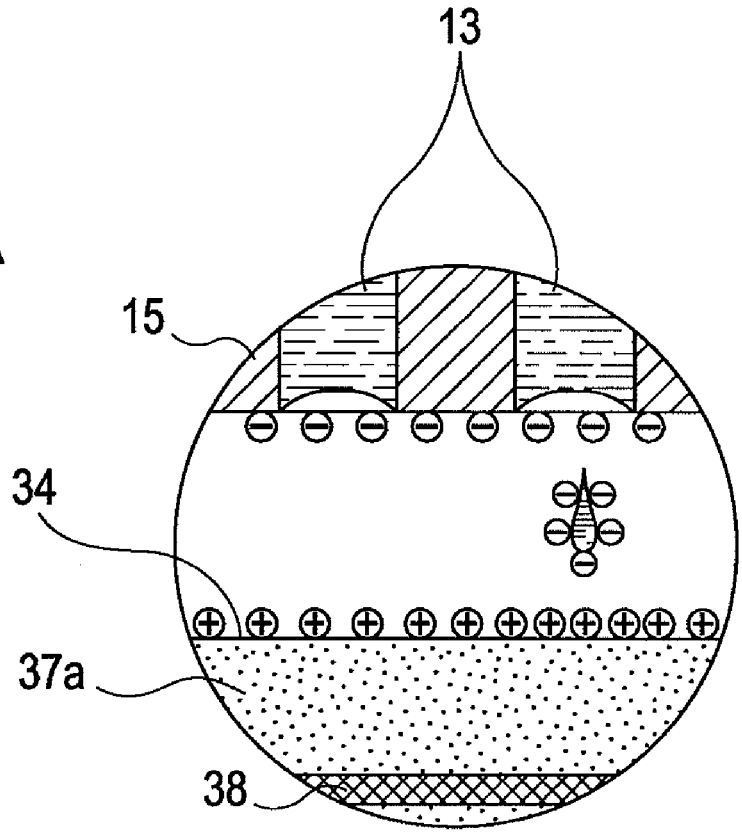
FIG. 6 is a schematic view for describing the principle of ink ejection inspection.
Figure 6B:
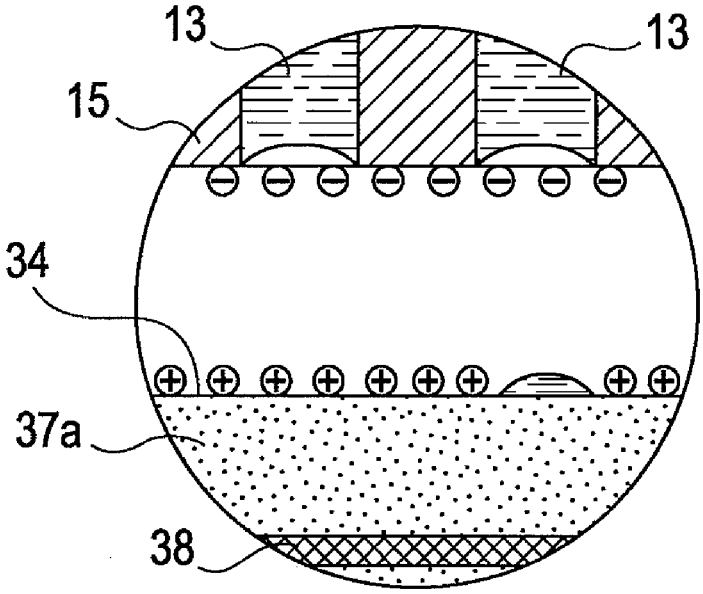

In the ejection inspection routine using the ejection inspecting unit 32 configured in this way, the recording head 2 is first placed above the cap member 33, and the cap member 33 is lifted upward by a lifting mechanism of the capping mechanism 8 to a position where the ink ejected from the recording head 2 can land on the inspection area 34 so that the inspection area 34 opposes the nozzle forming face (the nozzle plate 15) of the recording head 2 in a non-contacting state. Then, the piezoelectric elements 19 are driven with the above-described inspection driving pulse Pt in a state where an electric voltage is applied between the nozzle plate 15 and the electrode member 38 by the voltage application circuit 35, whereby ink is ejected from the nozzle openings 13. In the present embodiment, since the nozzle plate 15 serves as the negative electrode in FIG. 6A, a portion of the negative charges on the nozzle plate 15 are transferred to the ink, so that the ejected ink is negatively charged. As the ink droplet comes closer to the inspection area 34 of the cap member 33, the number of positive charges on the inspection area 34 (the top surface of the upper absorber 37*a*) increases due to electrostatic induction. In this way, the voltage between the nozzle plate 15 and the electrode member 38 becomes higher than the original voltage value in the state where no ink is ejected, because an induction current flows due to electrostatic induction. Thereafter, as illustrated in FIG. 6B, when the ink droplets land on the upper absorber 37*a*, the positive charge of the upper absorber 37*a* is neutralized by the negative charge of the ink. As a result, the voltage between the nozzle plate 15 and the electrode member 38 becomes lower that the original voltage value. Thereafter, the voltage between the nozzle plate 15 and the electrode member 38 is restored to the original voltage value.

Figure 7:
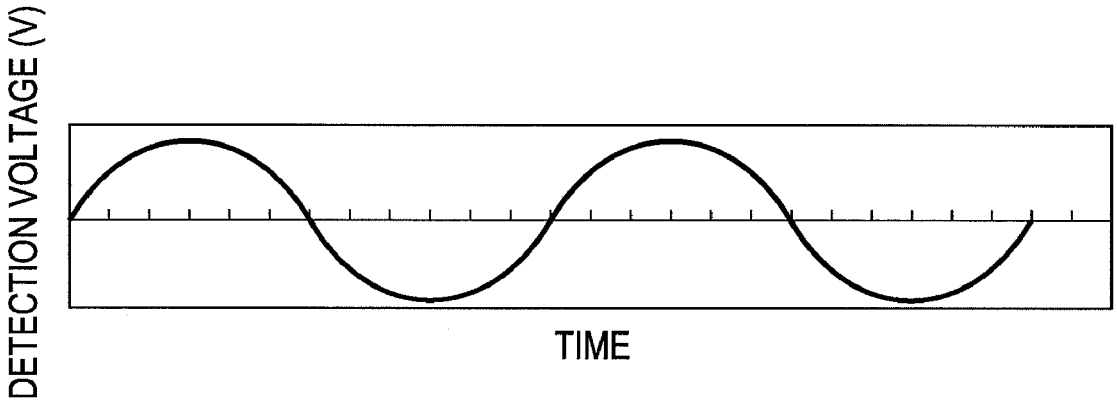
FIG. 7 a waveform diagram illustrating an example of the waveform of a detection signal output from a voltage detection circuit of the ejection inspecting unit.

FIG. 7 is a waveform diagram illustrating an example of the waveform of the detection signal output from the voltage detection circuit 36 of the ejection inspecting unit 32. Since the amplitude of a detection signal obtained with one shot of ink droplet is extremely small, ink is ejected for several times per one nozzle opening 13 during the inspection. By doing so, the detection signal can have an output waveform sufficiently large enough for inspection because the detection voltages obtained with a plurality of shots of ink are integrated by the integration circuit 40 and then inverted and amplified by the inverting amplification circuit 41. The amplitude sign of the signal output from the voltage detection circuit 36 is reversed because the signal passes through the inverting amplification circuit 41.

In this way, the ejection inspection is sequentially performed with respect to the respective nozzle openings 13 constituting the corresponding nozzle array 14 of each nozzle array 14, and the detection signals, which are the results of the inspection from the ejection inspecting unit 32, are accumulated in the RAM 28 of the controller 9. The CPU 26 of the controller 9 functions as an amplitude acquisition portion and acquires the amplitudes of the received detection signals. Specifically, the maximum value and the minimum value of the detection signals are detected, and the potential difference between them is acquired as the amplitude of the detection signal. Then, the CPU 26 makes a determination as to whether or not ink is properly ejected from the respective nozzle openings 13 based on the amplitude (the detection voltage) of the detection signal. When no ink is ejected from the nozzle openings 13 or the amount of the ejected ink is significantly lower than a predefined amount (a designed target ink amount), the amplitude of the detection signal is smaller than that of the normal case, namely when a predefined amount of ink is ejected from the nozzle openings 13, or is almost zero. Therefore, in such a case, the determination as to whether or not ink is properly ejected from the nozzle openings 13 can be made based on whether or not the amplitude of the detection signal is lower than a predetermined threshold value.

Figure 8:
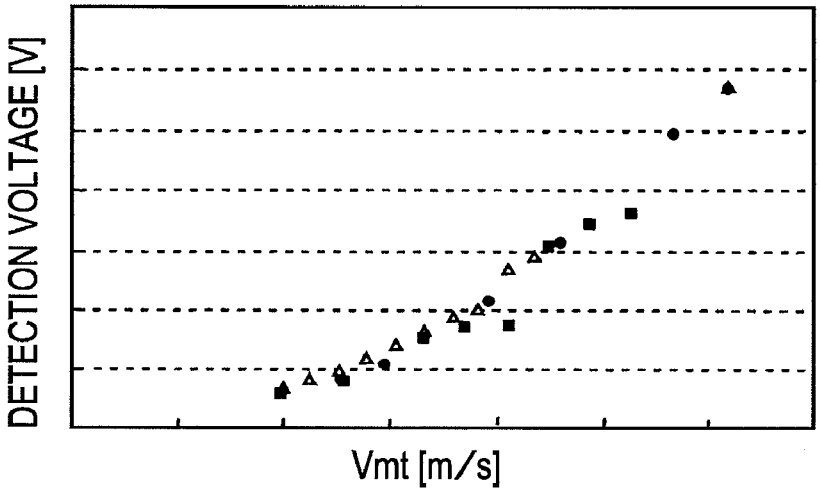
FIG. 8 is a graph illustrating the relationship between the flying speed of the ink and a detection voltage.

FIG. 8 is a graph illustrating the relationship between the flying speeds of the ink (the flying speed Vmt of the ink ejected using the inspection driving pulse Pt) and the amplitudes (the detection voltage [V]) of the detection signal. As illustrated in the drawing, the detection voltage [V] depends on the flying speed of the ink, and shows a tendency that the detection voltage [V] increases as the flying speed increases. Assuming that the amount of the charges changes by an amount dQ in a unit time dt when the charged ink has traveled to the inspection area 34 at the speed Vmt in an electric field between electrodes (that is, in the present embodiment, between the nozzle plate 15 and the inspection area 34) having a constant gap x, the current I flowing at that moment can be expressed by Equation 1 below. In this case, the direction (sign) of current is not taken into consideration.

$$I = Vmt \times dQ/dx \qquad \text{Equation 1}$$

Therefore, as is clear from Equation 1, since the higher the flying speed Vmt of the ink, the greater the generated current I becomes, and the detection voltage [V] increases accordingly.

In the printer 1 according to the invention, since the ejection inspection routine is performed using the inspection driving pulse Pt capable of increasing the flying speed Vmt of the ink compared to the case of normal printing, it is possible to increase the amplitude (the detection voltage [V]) of the detection signal compared to the configuration of performing the ejection inspection using the normal driving pulse P. Owing to such a configuration, it is possible to improve the detection sensitivity and improve the accuracy in determining whether or not ink has been ejected. Moreover, since the amplitude (the detection voltage [V]) of the detection signal can be increased, it is possible to decrease the number of ink ejections per one nozzle opening 13. As a result, it is possible to reduce the amount of ink consumed for the ejection inspection.

The invention is not limited to the described embodiment and various modifications may be made based on the disclosure of the claims.

For example, in the above-described embodiment, although a configuration is illustrated where the cap member 33 of the capping mechanism 8 is used as the liquid receiving portion of the invention, a separate liquid receiving portion exclusively for the ejection inspection may be provided.

In the above-described embodiment, although an example is illustrated where the electrode member 38 and the nozzle plate 15 of the recording head 2 are electrically connected so that the electrode member 38 serves as the positive electrode and the nozzle plate 15 serves as the negative electrode, the invention is not limited to this example. The polarities of both members may be reversed. Moreover, either one of the positive electrode and the negative electrode may be at approximately a zero potential, for example, the GND potential (ground potential). Furthermore, the conductive portion of the recording head is not limited to the nozzle plate 15, and other members may be used as long as they have conductive properties and have a portion thereof being in contact with ink in the recording head 2. Furthermore, although a configuration was illustrated where the voltage detection circuit detecting the electrical variation is connected to the electrode member 38 of the cap member 33, the voltage detection circuit may be connected to the conductive portion of the recording head.

In the above-described embodiment, although so-called vertical vibration mode piezoelectric elements 38 are illustrated as the ejection driving portion of the invention, the invention is not limited to this. For example, the piezoelectric elements may be provided for each pressure generating chamber 16 as in the case of so-called flexible vibration mode piezoelectric elements. In addition, other ejection driving portions such as heating elements may be used without being limited to piezoelectric elements.

The invention can be applied to other liquid ejecting apparatuses other than the printer. For example, the invention can be applied to apparatuses for manufacturing displays, electrodes, chips, and the like.

What is claimed is:

1. A liquid ejecting apparatus comprising:

a liquid ejecting head that ejects liquid from nozzle openings by the driving of an ejection driving portion;

a driving signal generation portion that generates a driving pulse for the driving of the ejection driving portion;

a liquid receiving portion that is disposed so as to oppose a nozzle forming face of the liquid ejecting head and receive ink ejected from the nozzle openings; and an ejection inspecting portion that detects an electrical variation occurring between a conductive portion of the liquid ejecting head and the liquid receiving portion when liquid is ejected toward the liquid receiving portion from the nozzle openings in a state where an electric voltage is applied between the conductive portion and the liquid receiving portion of the liquid ejecting head, thereby inspecting whether or not liquid has been ejected from the nozzle openings, wherein the driving signal generation portion generates a normal driving pulse which is used for processes other than an ejection inspection process by the ejection inspecting portion and an ejection inspection driving pulse which is different from the normal driving pulse and is used for the ejection inspection process by the ejection inspecting portion;

wherein the ejection inspection driving pulse is configured such that the flying speed of the liquid ejected during the ejection inspection process is higher than the flying speed of the liquid ejected in response to the normal driving pulse.

2. The liquid ejecting apparatus according to claim 1, wherein the processes other than the ejection inspection process include a printing process for ejecting ink as the liquid to perform printing on a recording medium.

3. An ejection inspecting method in which a liquid receiving portion configured to receive liquid ejected from nozzle openings is disposed so as to oppose a nozzle forming face of a liquid ejecting head configured to eject liquid from the nozzle opening by driving of an ejection driving portion, and an electrical variation is detected which occurs between a conductive portion of the liquid ejecting head and the liquid receiving portion when liquid is ejected toward the liquid receiving portion from the nozzle openings in a state where an electric voltage is applied between the conductive portion and the liquid receiving portion, thereby inspecting whether or not liquid has been ejected from the nozzle openings, wherein an ejection inspection process is performed using an ejection inspection driving pulse having a different form than a normal driving pulse which is used for processes other than the ejection inspection process;

wherein the ejection inspection driving pulse is configured such that the flying speed of the liquid ejected during the ejection inspection process is higher than the flying speed of the liquid ejected in response to the normal driving pulse.

4. The ejection inspecting method according to claim 3, wherein the processes other than the ejection inspection process include a printing process for ejecting ink as the liquid to perform printing on a recording medium.

* * * * *